United States Patent [19]

Jaffa

[11] 4,031,825

[45] June 28, 1977

[54] PALLET MOUNTING APPARATUS FOR SCREEN PRINTING MACHINES

[75] Inventor: David Jaffa, Fairlawn, N.J.

[73] Assignee: Precision Screen Machines Inc., Hawthorne, N.J.

[22] Filed: Feb. 13, 1976

[21] Appl. No.: 657,872

[52] U.S. Cl. ..... 101/126; 101/407 BP; 198/648

[51] Int. Cl.² ..... B41F 15/26

[58] Field of Search ..... 101/126, 123, 41, 124, 101/43, 44, 407 BP; 198/131, 133, 181, 182, 19, 648, 472, 798; 108/13, 90, 102, 111, 114; 297/148, 149, 153; 269/309; 40/17, 18, 156

[56] References Cited

UNITED STATES PATENTS

| | | | |
|---|---|---|---|
| 1,975,717 | 10/1934 | Harris | 198/181 |
| 2,436,150 | 2/1948 | Moehle | 40/17 X |
| 3,308,916 | 3/1967 | Canny et al. | 197/36 |
| 3,587,829 | 6/1971 | Sorensen | 198/131 |
| 3,780,652 | 12/1973 | Black et al. | 101/126 X |
| 3,795,189 | 3/1974 | Jaffa | 101/126 X |
| 3,854,398 | 12/1974 | Martin | 101/126 X |

*Primary Examiner*—Edgar S. Burr

*Assistant Examiner*—R. E. Suter

*Attorney, Agent, or Firm*—Philip D. Amins

[57] ABSTRACT

This disclosure is directed to a pallet locating and positioning apparatus for use on a screen printing machine having an oval track about which a series of pallets supporting work pieces are indexed from station to station. An internal surface of a side rail of a hollow rectangular pallet engages outwardly biased detenting fingers which are affixed on adjacent parallel lateral edges of a pallet base plate driven about the endless track of the screen printing machine. One finger engages a complementary shaped notch in the side rails accurately detenting the pallet along the longitudinal axis of the pallet base plate. Another finger is in touching engagement with a straight portion of the same side rail urging the pallet outwardly from the adjacent parallel edges of the pallet base plate to which the fingers are attached, thereby causing the internal surface of an opposed parallel side rail of the pallet to come into touching engagement with an opposed lateral edge of the pallet base plate, thereby preventing shifting of the pallet in a direction transverse to the longitudinal axis of the pallet base plate.

10 Claims, 4 Drawing Figures

PALLET MOUNTING APPARATUS FOR SCREEN PRINTING MACHINES

BACKGROUND OF THE INVENTION

This invention relates to screen printing machines which index pellets and more particularly, to an apparatus directed to detenting disengageable pallets to a pallet base plate operably indexed by the screen printing machine.

DESCRIPTION OF THE PRIOR ART

My U.S. Pat. No. 3,795,189 issued on Mar. 5, 1974, discloses a screen printing machine with an oval rail for indexing pellets in a unitary plane. The pallets and the work pieces supported thereon, are indexed from station to station. Pallet base plates provide support for the pellets which may be disengaged from time to time from the base plates. Accurate registration of the pallet base plate is achieved by a locating bar which engages a notch in the pallet base plate when the base plate is stationary and has been indexed to a working station where a printing head assembly is operatively associated for movement into and out of printing relationship with the work piece supported by the pallet. The quality of the screen printing process is dependent upon the accurate registration of the removable pallet to the base plate supporting it.

The rectangularly shaped base plate portion of the screen printing machine must provide support to the pallet while accurately locating and constraining the pallet in a fixed operable location thereupon. The reduced end portion of the base plate must be available to the base plate locking mechanism, and the pallet must be effectively detented to the base plate without modification or interference with the reduced end portion thereof. The instant invention utilizes the two opposed longitudinal marginal edges of the generally rectangularly shaped base plate to detent the pallet to the base plate and to prevent any side to side lateral displacement of the pallet in a direction transverse to the longitudinal axis of the base plate. A pair of cam-like fingers are installed on one marginal edge of the base plate, having two parallel adjacent surfaces, for engagement with an innermost vertical surface of a side rail, disposed downwardly from the lowermost, planar surface of the pallet. One of the fingers is biased outwardly in the vicinity of a V-shaped portion of its surface that is adapted to engage a complementary oppositely directed V-shaped notch in the adjacent vertical surface of the pallet side rail. The other finger having a similarly outwardly directed portion of its surface which is V-shaped, is restrained from unlimited displacement inwardly towards the center of the supporting plate, providing thereby, a controlled resistive outwardly directed force against the surface of the side rail. The combined action of both fingers results in detenting and locking another side rail in touching engagement with the opposite longitudinal marginal edge of the pallet supporting base plate.

BRIEF DESCRIPTION OF THE DRAWINGS

The foregoing and other objects, features and advantages of the present invention will become more apparent from the detailed description hereinafter when considered in conjunction with the accompanying drawings, wherein.

DESCRIPTION OF THE PREFERRED EMBODIMENT

Figure 1:
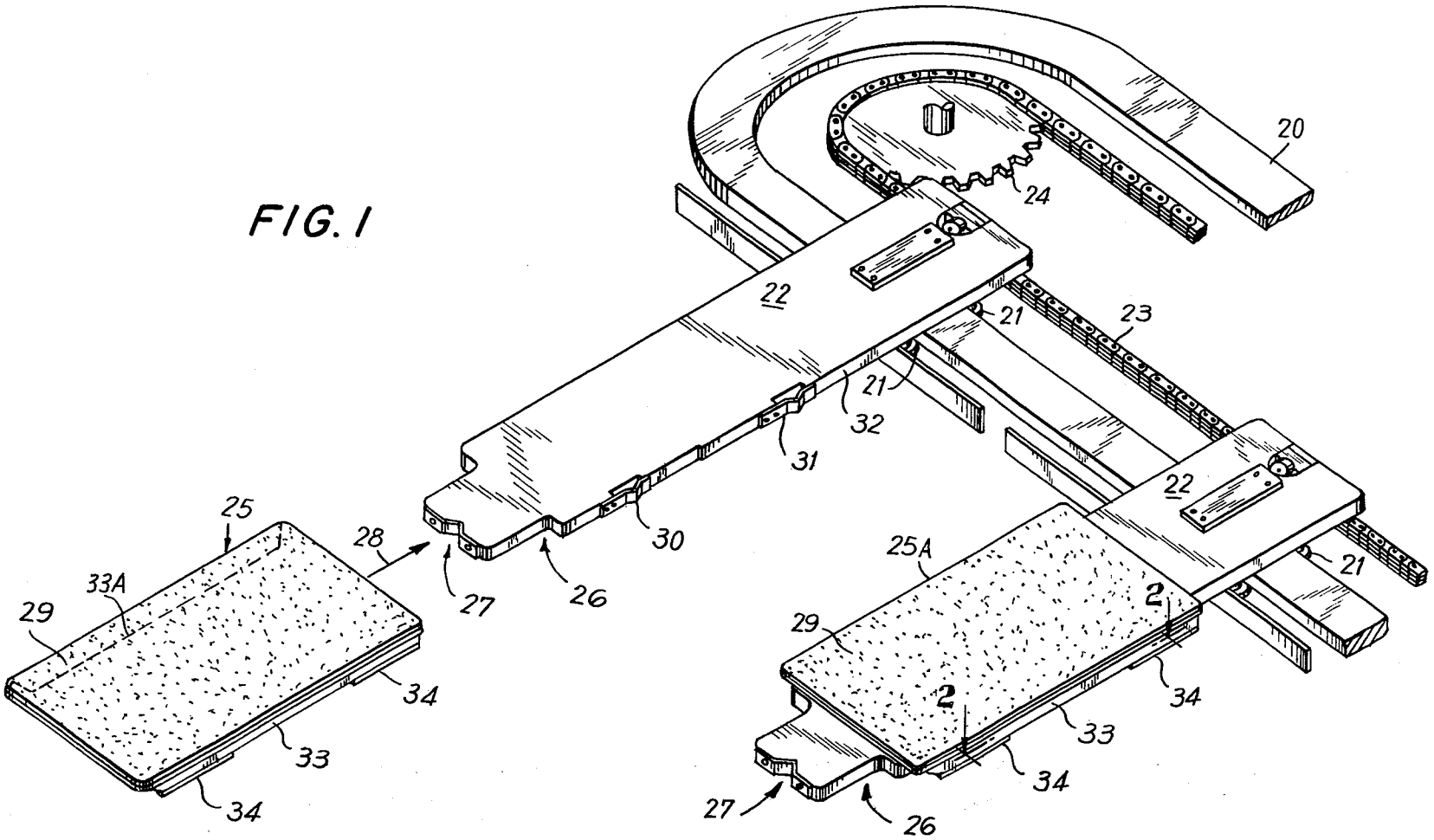
FIG. 1 is a perspective view of a portion of a screen printing machine including one pallet installed on a base plate and another pallet shown disengaged from an adjacent base plate.

The structure and method of fabrication of the present invention is applicable to a pallet base plate having a generally rectangular shape extending outwardly from the support rail of a screen printing machine. The base plate has a reduced outermost end portion and a locating notch therein. The end portion and notch are utilized by the screen printing machine to lock the base plate into a fixed position when the base plate has been indexed into an operating station. Pallets are removably installed on the base plate leaving the reduced end portion and the notch therein free for operative engagement with the base plate locating mechanism. The pallets comprise an uppermost, plate which supports work pieces thereon. Each pallet is equipped with a pair of parallel spaced apart side rails affixed to the undersurface of the work piece supporting lateral surface. A pair of spaced apart metallic sheets are secured to the lowermost surfaces of the side rails, which provide reinforcement for the side rails preventing them from twisting and from any angular displacement of the opposed inner vertical surfaces thereof.

The pallet base or supporting plate has two rectangular notches disposed in spaced apart relationship. A pair of metallic striplike fingers, each bent to have a V-shaped surface, are affixed to one of the longitudinally extending marginal edges of the base plate having the rectangular notches formed therein. The apex of the V-shape extends outwardly from the marginal edge and is located within the boundaries of its associated rectangular notch. A pair of screws affix one end of each finger to the surface of the marginal edge adjacent to each major rectangular notch closest to the reduced end portion of the pallet base plate. The surface of the free end of one finger is in touching engagement with one of the adjacent parallel surfaces upon which it is mounted. Inwardly directed forces applied to the finger causes the free edge thereof to slide upon the surface utilized for mounting until the free edge engages the wall extending normally between the two adjacent parallel surfaces and is prevented from further displacement thereby. Thus, the engagement of the free edge of the finger prevents the unlimited inward displacement of the V-shaped surface without the introduction of strongly opposed outwardly directed forces.

The other free end of the other finger is in touching engagement with the other adjacent parallel marginal surface. The V-shaped surface of this spring finger is adapted to engage a V-shaped notch located in the interior vertical surface of a side rail of a pallet. Detenting is achieved relative to a point located along the longitudinal axis of the pallet supporting plate thereby.

The spring finger whose free edge contacts the wall normal to both parallel adjacent surfaces, applies an outwardly directed force to the side rail in which the V-shaped notch is located. Thus, the opposite side rail is forced in touching engagement with the entire coextensive length of the opposite marginal edge of the supporting base plate. The detenting spring finger contributes to the outwardly directed forces applied to the side rail as does the other spring finger.

Moderate forces directed towards the track of the screen printing machine applied along the direction of the longitudinal axis of the base plate are utilized to engage the pallet in a detented position accompanied by locating a longitudinal edge of the pallet along a line parallel to the longitudinal axis of the base plate. Opposed forces, of moderate magnitude, successfully accomplish the displacement of the pallet from the detented position and the removal from the pallet supporting plate.

Referring now to FIG. 1, there is shown an oval track 20 upon which pallet base plates 22 travel. Wheels 21 provide guidance for the base plates as they travel about track 20, utilizing flexible chain 23 therefor. Sprocket 24 drives chain 23. The pallet base plate on pallet supporting plate 22 has a reduced end portion 26 and a locating notch 27, both of which are utilized to lock the base plate 22 in a preferred location when the base plate is stationary, utilizing a locking mechanism (not shown) which is a part of the screen printing machine. Pallet 25, when moved in the direction of arrow 28 is caused to be installed upon the pallet base plate 22 in the position illustrated by pallet 24A; and the pallet is partially supported by the uppermost planar surface of the pallet base plate 22. The plate 29 of pallet 25A is utilized as a support for a work piece (not shown). Fingers, or metallic bars, 30 and 31 are installed on a side marginal edge 32 of the base plate 22 and are intended to engage the innermost vertical surface of side rail 33 of pallet 25. Metallic reinforcing layers or sheets 34 provide a closed truss-like surface for side rail 33 and a twin parallel located side rail 33A (schematically shown in dashed lines in FIG. 1).

Figure 2:
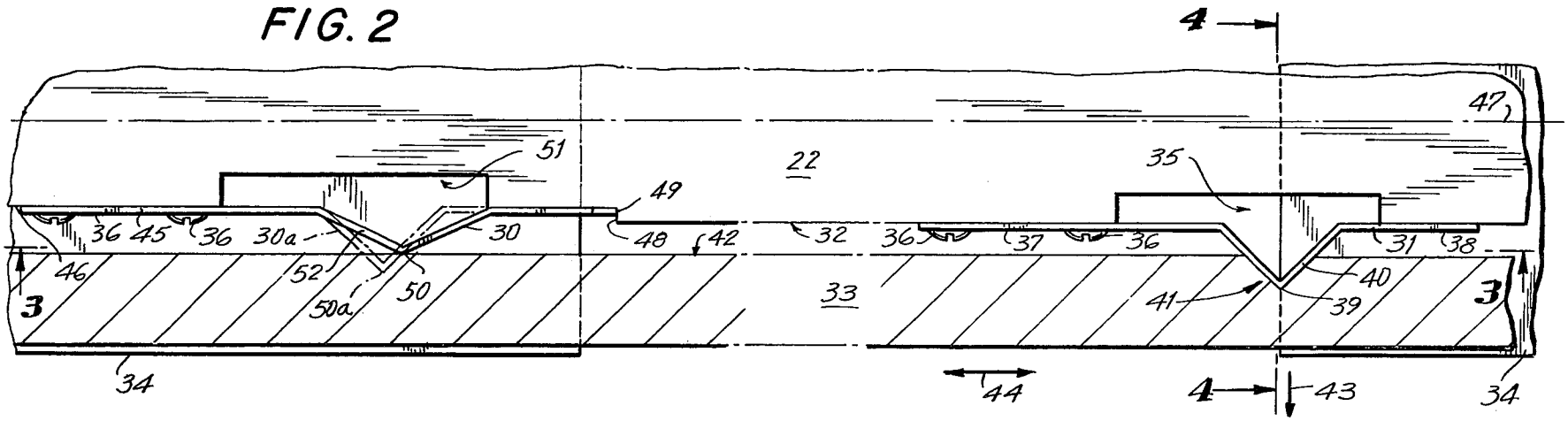
FIG. 2 is a partial cross-sectional plan view taken through lines 2—2 viewed in the direction of arrows 2—2, as shown in FIG. 1, showing a portion of a side rail of a pallet in touching engagement with detenting fingers affixed to a portion of a pallet base plate.

FIG. 2 shows a portion of base plate 22, in plan view, and a portion of the length of side rail 33 in plan view, exposed by the removal of plate 29, shown in FIG. 1. Rectangular notch 35 is disposed adjacent to finger 31, and is located in marginal edge 32 of base plate 22. Screws 36 secure end 37 of finger 31 to marginal edge 32. End 38, of finger 31 rests upon marginal edge 32. The apex 39 of the V-shaped excursion 40 in finger 31 resides in V-shaped notch 41 located in the innermost surface 42 of side rail 33. Finger 31 places an outwardly directed force, in the direction of arrow 43, due to its spring-like character, causing it to reside securely within V-shaped notch 41. Side rail 33 is unable to move in the direction of arrows 44 unless a substantial overcoming force is applied to side rail 33, in the direction of arrows 44, overcoming the outwardly applied forces from spring finger 31, in the direction of arrow 43. When such unseating forces are applied, side rail 33 displaces in either direction of arrows 44, causing the apex 39 of spring finger 31 to move in a direction opposite to arrow 43 and to deflect the portions of spring finger 31 adjacent the V-shaped excursion 40 thereof to enter rectangular notch 35. End 38 of spring finger 31 is caused to move in a direction away from screws 36. When apex 39 is totally disengaged from V-shaped notch 41, apex 39 remains in frictional contact with the innermost surface 42 of side rail 33 until such time as the side rail 33 is totally withdrawn from touching engagement with spring finger 31. Spring finger 30 utilizes screws 36 to affix end 45 thereof to surface 46 of pallet base plate 22. Surface 46 is disposed inwardly toward the center line 47 of base plate 22 a lesser distance than surface 32. Shoulder 48 engages edge 49 of spring finger 30 in the position shown. Apex 50 of spring finger 30 is in touching engagement with innermost surface 42 of side rail 33 causing the side rail to move in the direction of arrow 43 into the position shown. When edge 49 engages shoulder 48, apex 50 increases the force exerted in the direction of arrow 43 against surface 42 of side rail 33, creating a substantial increase in the tendency for side rail 33 to shift outwardly, in the direction of arrow 43 away from longitudinal axis 47, causing the other side rail (not shown) to engage the other side marginal edge (not shown) of pallet base plate 22 on the other side of longitudinal axis 47 to securely contact each other. Rectangular notch 51 accommodates the portions of finger 30 adjacent its V-shaped area 52 that are deflected inwardly, in a direction opposite to arrow 43. Spring finger 30 assumes the shape illustrated by phantom lines 30A when side rail 33 is totally disengaged from apex 50A.

Figure 3:
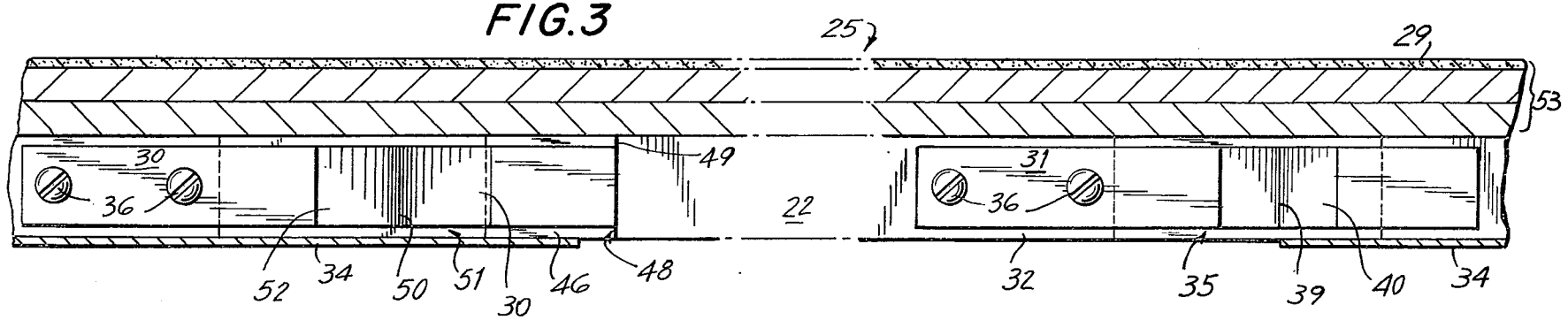
FIG. 3 is a side elevational view taken through lines 3—3, viewed in the direction of arrows 3—3, as shown in FIG. 1, illustrating the lateral side edge of the base plate and the cross-sectional elevational view of the pallet installed thereupon.

FIG. 3 shows the uppermost surface of plate 29 of pallet 25, which plate 29 includes laminate layers 53, to thereby form a rigid, light weight supporting structure for the work piece, (not shown) to be carried thereupon. Spring finger 30 has the apex 50 of the V-shaped area 52 thereof residing over the rectangular notch 51 located in surface 46 of pallet base plate 22. Similarly, spring finger 31 has the apex 39 of its V-shaped excursion 40 thereof residing over the rectangular notch 35, located in surface 32 of pallet base plate 22.

Figure 4:
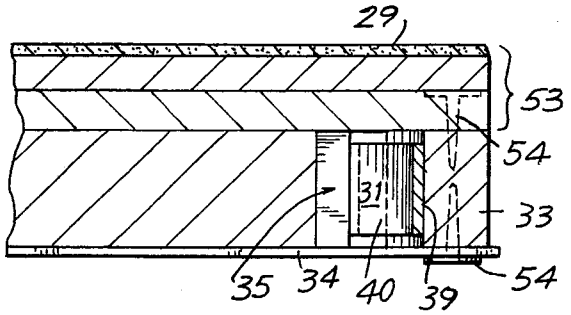
FIG. 4 is a side elevational cross-sectional view taken through lines 4—4, viewed in the direction of arrows 4—4, as shown in FIG. 2, illustrating a portion of the pallet base plate and a finger attached thereto, engaged within a side rail of the pallet, shown in cross-sectional view.

FIG. 4 shows fasteners 54, one of which is utilized to secure metallic sheet 34 to side rail 33 while having its head portion concealed within the laminate. Rectangular notch 35 is shown adjacent to excursion 40 of spring finger 31, shown having its apex 39 engaged within the V-shaped notch 41, shown in FIG. 2.

One of the advantages is a pallet locating and positioning apparatus with accurate detenting means for locating a pallet to a fixed point along the longitudinal axis of a pallet supporting base plate.

Another advantage is a pallet locating means which accurately positions the pallet insuring against transverse displacement from the longitudinal axis of the pallet supporting base plate.

Still another advantage is a pallet locating apparatus which is inexpensive and does not require manual complex operations to detent the pallet to the base plate during installation or subsequent removal from the pallet.

Yet another advantage is a pallet locating apparatus for use on hollow pallets having two side rails.

A still further advantage is a pallet detenting apparatus which is used in conjunction with conventional pallets.

Thus, there is disclosed in the above description and in the drawings, an embodiment of the invention which fully and effectively accomplishes the objects thereof. However, it will become apparent to those skilled in the art, how to make variations, modifications and changes to the instant invention. Therefore, this invention is not to be limited by the specific disclosure herein, but only by the appending claims.

What is claimed is:

1. A pallet locating apparatus comprising a pallet supporting plate,
said pallet support plate being affixed to the indexing mechanism of a screen printing machine,
means for supporting said pallet on said pallet support plate,
said pallet supporting plate having a first marginal edge extending outwardly from said indexing mechanism,
detenting means for releasably engaging said pallet with respect to said pallet supporting plate,
said pallet including a first longitudinally extending side rail, and
locating means for positioning said first side rail in touching engagement with said first marginal edge of said pallet supporting plate.

2. A pallet locating apparatus in accordance with claim 1, wherein
said means for supporting said pallet on said pallet supporting plate comprises an uppermost surface of said pallet supporting plate,
said pallet having a work piece supporting plate, and
said work piece supporting plate having a lowermost surface supported on said uppermost surface of said pallet supporting plate.

3. A pallet locating apparatus in accordance with claim 2, wherein
said detenting means comprises a second side rail fixedly secured to said lowermost surface of said work piece supporting plate,
said second side rail having a first surface normal to said lowermost surface of said work piece supporting plate,
a notch located in said first surface of said second said rail,
a detenting finger affixed to a second marginal edge of said pallet supporting plate,
said second marginal edge being parallel to said first marginal edge of said pallet supporting plate,
a portion of said detenting finger being biased outwardly from said second marginal edge of said pallet supporting plate, and
said portion of said detenting finger being capable of detenting engagement with said notch.

4. A pallet locating apparatus in accordance with claim 3, wherein
said locating means comprises said first longitudinally extending side rail,
said first side rail of said pallet being disposed in perpendicular relationship to said lowermost surface of said work piece supporting plate and parallel to said first surface of said second side rail,
said pallet supporting plate having a third marginal edge,
said third marginal edge being disposed parallel and adjacent to said second marginal edge of said pallet supporting plate,
a locating finger affixed to said third marginal edge of said pallet supporting plate,
a portion of said locating finger being biased outwardly from said third marginal edge of said pallet supporting plate, and
said portion of said locating finger being capable of touching engagement with said first surface causing said first surface to be disposed outwardly from said third marginal edge for translating said first side rail of said pallet in touching engagement with said first marginal edge of said pallet supporting plate.

5. A pallet locating apparatus in accordance with claim 3, wherein
said detenting finger comprises a first metallic bar having a V-shaped excursion therein located intermediate the ends thereof,
one of said ends being fixedly secured to said second marginal edge of said pallet supporting plate,
the apex of said V-shaped excursion of said first bar extending outwardly from said ends of said first bar and from said second marginal edge of said pallet supporting plate,
the other end of said first bar being located intermediate said one end of said first bar and said indexing mechanism, and
said other end of said first bar being in frictional and slidable touching engagement with said second marginal edge of said pallet supporting plate and said apex for detenting engagement with said notch.

6. A pallet locating apparatus in accordance with claim 4, wherein
said locating finger comprises a second metallic bar having a V-shaped excursion therein located intermediate the ends thereof,
one of said ends being fixedly secured to said third marginal edge of said pallet supporting plate,
the apex of said V-shaped excursion of said second bar extending outwardly from said ends of said second bar and said third marginal edge of said pallet supporting plate,
the other end of said second bar being located intermediate said one end of said second bar and said detenting finger,
said other end of said second bar being in touching engagement with said third marginal edge of said pallet supporting plate, and
said apex of said second bar being disposed in slidable frictional engagement with said first wall of said first side rail.

7. A pallet locating apparatus in accordance with claim 6, wherein
said locating means further comprises a shoulder,
said shoulder being disposed intermediate one end of said second marginal edge and one end of said third marginal edge,
said shoulder lying in a plane normal to said second marginal edge and said third marginal edge, and
the other end of said locating finger being disposed in touching engagement with said shoulder when said apex of said outwardly extending excursion is in touching engagement with said first surface of said second side rail.

8. A pallet locating apparatus in accordance with claim 5, wherein
said detenting means further comprises a first rectangular notch, and said first rectangular notch being located in said second marginal edge of said pallet supporting plate and intermediate said ends of said first bar.

9. A pallet locating apparatus in accordance with claim 6, wherein said locating means further comprises a second rectangular notch, and said second rectangular notch being located in said third marginal edge of said pallet supporting plate and intermediate said ends of said second bar.

10. A pallet locating apparatus in accordance with claim 3, further including a sheet, said sheet being fixedly secured to the lowermost surface of said second rail, said sheet being disposed in a plane parallel to and in spaced apart relationship from said lowermost surface of said work piece supporting plate, said work piece supporting plate having a lowermost lateral surface, and said lowermost lateral surface being disposed in a plane disposed above said sheet.

* * * * *

UNITED STATES PATENT OFFICE

CERTIFICATE OF CORRECTION

Patent No. 4,031,825 Dated June 28, 1977

Inventor(s) David Jaffa

It is certified that error appears in the above-identified patent and that said Letters Patent are hereby corrected as shown below:

Claim 1, line 3, "support plate" should read -- supporting plate --;

line 6, "support plate" should read -- supporting plate --.

Claim 3, line 10, "said" should read -- side --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*